US007327246B2

(12) United States Patent
Schoor

(10) Patent No.: US 7,327,246 B2
(45) Date of Patent: Feb. 5, 2008

(54) SAFETY SHUT-OFF SYSTEM

(76) Inventor: Wolfgang Schoor, 238 Villa Street, Thunder Bay, Ontario (CA) P7A 3Y2

( * ) Notice: Subject to any disclaimer, the term of this patent is extended or adjusted under 35 U.S.C. 154(b) by 208 days.

(21) Appl. No.: 11/039,798

(22) Filed: Jan. 24, 2005

(65) Prior Publication Data

US 2006/0170542 A1 Aug. 3, 2006

(51) Int. Cl.
*G08B 29/00* (2006.01)

(52) U.S. Cl. ..... 340/506; 340/3.1; 340/507; 340/635

(58) Field of Classification Search ..... 340/506, 340/3.1, 507, 514, 517, 521, 577, 635, 3.43, 340/679

See application file for complete search history.

(56) References Cited

U.S. PATENT DOCUMENTS 4,659,909 A 4/1987 Knutson
5,400,766 A * 3/1995 Dillon ..... 126/42
5,742,464 A 4/1998 Ceola et al.
5,945,017 A 8/1999 Cheng et al.
6,025,788 A * 2/2000 Diduck ..... 340/870.16
6,046,441 A * 4/2000 Daffron ..... 219/506
6,130,412 A 10/2000 Sizemore
6,172,612 B1 * 1/2001 Odachowski ..... 340/628

* cited by examiner

*Primary Examiner*—Daryl C Pope
(74) *Attorney, Agent, or Firm*—Ryan W. Dupuis; Michael R. Williams; Adrian D. Battison

(57) ABSTRACT

A safety shut-off system controls power supply to an appliance to prevent accidental fires and the like. The shut-off system includes a shut-off switch for connection in series with the power supply of the appliance. A controller opens the switch in response to detection by the detector of a prescribed fire condition. Failsafe means are provided on the controller for opening the shut-off switch in response to a malfunction of the detector to, ensure that the appliance is only permitted to operator under safe conditions when the detector is properly operating. In order to avoid false alarms the detector may take various forms including the detection of sound or other conditions which may be indicative of a potential fire. There are also incorporated switching capabilities to control additional a/c outlets, gas, propane and other appliances which work in unison with this system.

18 Claims, 3 Drawing Sheets

SAFETY SHUT-OFF SYSTEM

FIELD OF THE INVENTION

The present invention relates to a safety shut-off system for controlling power supply to an appliance, for example a cooking range to discontinue power being supplied in the event of a prescribed fire condition.

BACKGROUND

A known occurrence when using a cooking appliance is for fires to develop when the appliance is left unattended. If forgotten for an elapsed period of time, the appliance being left on can cause the fire to continue for a greater duration or to worsen causing greater damage then had the appliance been turned off.

U.S. Pat. Nos. 6,130,412, 5,945,017 and 5,742,464 disclose devices which address similar problems. U.S. Pat. No. 4,659,909 to Knutson in particular discloses a kitchen range safety shutoff in which an appliance is arranged to be turned off in response to detection by a smoke detector of a possible fire. Reliance upon a smoke detector can be misleading however and can cause many false alarms. Furthermore arrangement of the shutoff disclosed in Knutson would permit the appliance to continue to operate in the event of a power loss or failure of some form to the detector.

SUMMARY

According to one aspect of the present invention there is provided a safety shut-off system, for controlling power supply to an appliance, the shut-off system comprising:

a shut-off switch for connection in series with the power supply of the appliance;

a detector for detecting a prescribed fire condition; and a controller for opening the switch in response to detection by the detector of the prescribed fire condition;

the controller including failsafe means for opening the shut-off switch in response to a malfunction of the detector.

The use of a safety shutoff system including failsafe means ensures that the appliance is only permitted to operate under safe conditions when the detector is properly operating. In order to avoid false alarms the detector may take various forms including the detection of sound or other conditions which may be indicative of a potential fire.

The prescribed fire condition may include elevated temperatures, ionization of air, smoke which blocks the light transmission through air, sounds indicative of a fire about to start or any combination thereof.

The prescribed fire condition preferably comprises noises which are recorded by the detector which are indicative of the noises made by a cooking fire just before ignition thereof.

Loss of power to the detector is preferably interpreted as a malfunction for opening the switch.

There may be provided a relay to prevent opening of the switch until the prescribed fire condition is detected over an elapsed period of time.

The detector preferably activates a first indicator immediately in response to detecting a prescribed fire condition and the controller preferably activates a second indicator in response to the shutoff switch being opened.

The controller may include a reset switch located remotely therefrom.

Working components of the system may be integrally located within a common housing in a first embodiment of the system. Alternatively, working components of the system may be located remotely from one another within respective housings for hardwiring within a building structure.

There may be provided a receptacle receiving power from the power supply which is interrupted by the shutoff switch.

There may be provided a main control station monitoring a plurality of controllers in association with respective appliances.

The main control station preferably includes a memory for recording detections of prescribed fire conditions and resetting means for remotely closing the shut-off switch.

BRIEF DESCRIPTION OF THE DRAWINGS

In the accompanying drawings, which illustrate exemplary embodiments of the present invention.

DETAILED DESCRIPTION

Figure 1:
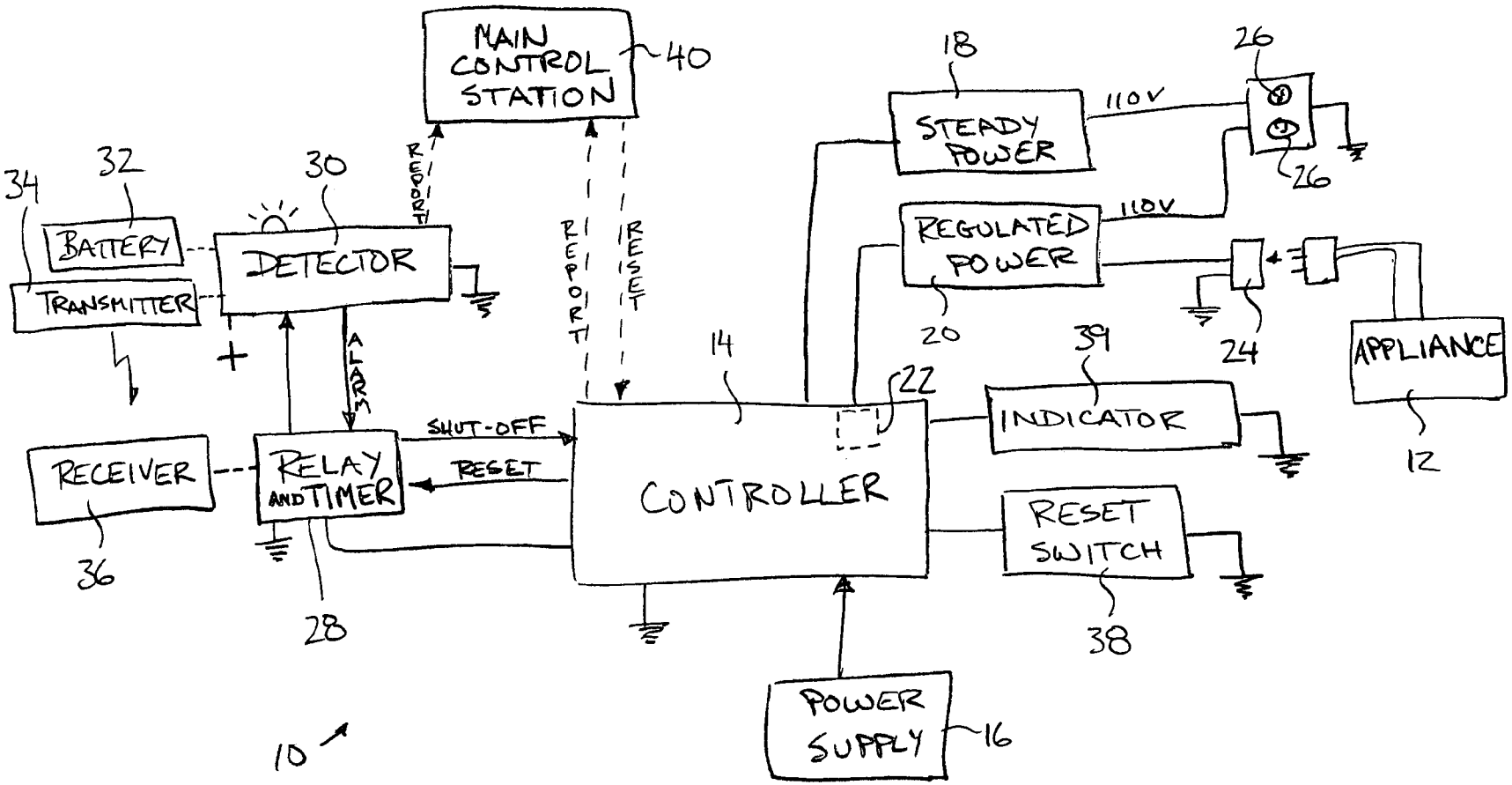
FIG. 1 is a schematic view of the components of the safety shutoff system.

Referring to the accompanying drawings, there is illustrated a safety shutoff system generally indicated by reference numeral 10. The system 10 is particularly useful for shutting off appliances, for example an electrical cooking range 12, in the event of a prescribed fire condition.

While various embodiments are possible and illustrated herein, the common features of each as schematically illustrated in FIG. 1 will first be described herein. The system includes a controller 14 which interrupts the normal power supply 16 to which the cooking range 12 plugs into. The controller 14 branches the power supply 16 into a steady power branch 18 which remains unaffected by the shutoff of the system and a regulated power branch 20 which is shutoff and interrupted in response to the prescribed fire condition. The regulated power branch is interrupted by a shutoff switch 22 formed integrally within the controller 14 to interrupt power when the switch is open. The regulated power branch includes a socket 24 at a line voltage of 220 volts, or other suitable voltage where available, for plugging in a conventional electric cooking range therein. An electrical outlet is also provided having a receptacle 26 formed therein which is associated with each one of the regulated and steady power branches 18 and 22 at a lesser line voltage of 110 volts.

The controller also provides power to a relay 28 which relays an alarm signal from a detector 30 of the system. The detector 30 may comprise a conventional smoke detector for producing an alarm signal in response to heat, ionisation, smoke or any combination thereof. The detector 30 may also comprise a sound detector which is able to record sounds and compare them to known sounds indicative of a prescribed fire condition. An example of a sound which may be indicative of a fire is the sound produced by grease cooking just prior to ignition thereof to produce a grease fire on a cooking range.

The detector 30 typically receives power from the relay 28, however in alternative embodiments the detector may be provided with a battery 32 for wireless and remote operation thereof. In this instance a transformer 34 is provided on the detector for communication with a receiver 36 on the relay 28.

The relay 28 receives the alarm signal from the detector in the event that a prescribed fire condition is detected and the normal indicators of the detector itself are immediately activated in the form of lights or noise to alert an operator.

The relay includes an integral time delay to record the alarm signal and in turn relay a shutoff signal to the controller only if the alarm signal is detected from the detector for an elapsed period of time.

The relay is arranged to receive a steady power signal from the detector under normal conditions and accordingly the alarm signal from the detector to the relay takes the form of an interrupted signal or absence of signal for an elapsed period of time. Accordingly if the detector either detects a prescribed fire condition or loses power or occurs any other failure, the absence of a signal from the detector to the relay in the form of the alarm signal will cause the relay to send a shutoff signal to the controller upon expiration of the elapsed period of time prescribed by the relay. Once the shutoff signal has been sent, the relay 28 is reset by a reset signal activated from the controller. Resetting typically takes place by means of a manual reset switch 38.

Receipt of the shut-off signal from the relay by the controller cause the indicator 39 of the controller to be activated. This indicator may also be any conventional type of indicator including lights or noises and the like similar to the integral indicators of the detector.

Once the controller has been notified by a shutoff signal from the relay the shutoff switch 22 is opened to interrupt the regulated power branch 20 of the power supply which effectively cuts off power to the appliance. Activation by the manual reset switch 38 or other reset means causes power to be resumed and causes the relay and detector to be reset to start over the cycle of checking for prescribed fire conditions by the detector.

A main control station 40 may be provided which is particularly useful when a plurality of controllers are provided, each associate with a respective appliance, for example in an apartment complex where each apartment is provided with its own appliance regulated by power from a respective controller. The controller and the relay are suitably arranged for reporting alarm signals from the detector and shutoff signals from the relay so that these reported incidents can be kept in a memory log of the control station in which each incident is associated with an identification of the appliance in question affected by the detection of a prescribed fire condition. Resetting in this instance can be accomplished by a reset signal sent remotely from the main controller 40 directly to the controller 14 of a respective one of the appliances of the system.

Figure 3:
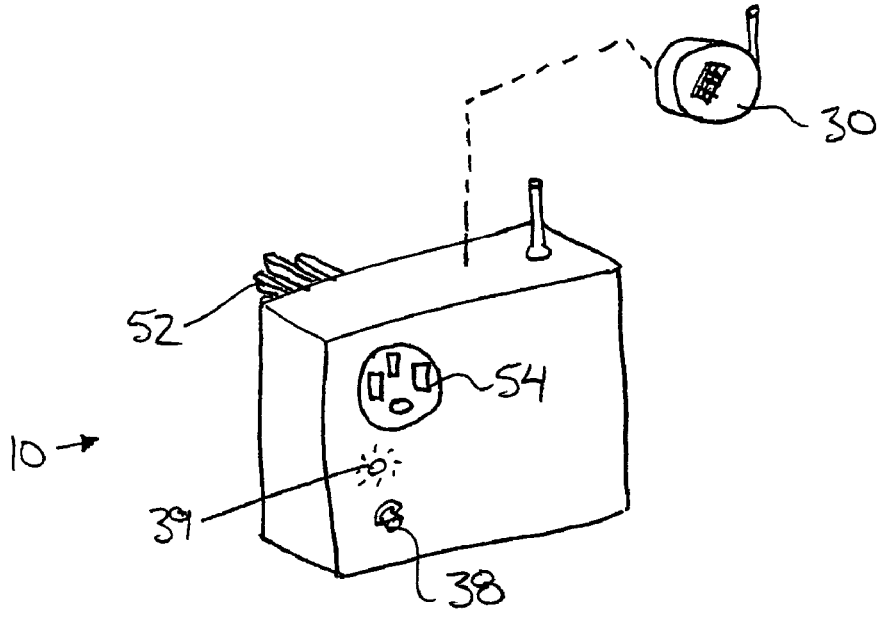
FIGS. 3 and 4 are perspective views of two different embodiments of the safety shutoff system.

In the embodiment of FIG. 3, the components of the system are shown supported integrally within a single housing 50 in which a male connector 52 and a female power connector 54 are provided for connection in series with the conventional plug in of an appliance to a receptacle in the wall. The indicator 39 of the system is provided in a visible location on the housing 50 as is the manual reset switch 38. The detector 30 remains positioned remotely from the housing 50 in an optimum location for detecting the prescribed fire condition in the cooking area over the appliance. In the embodiment of FIG. 3, antennas relating to the transmitter 34 and receiver 36 are illustrated in solid line while a direct wired communication is shown in dotted line.

Figure 4:
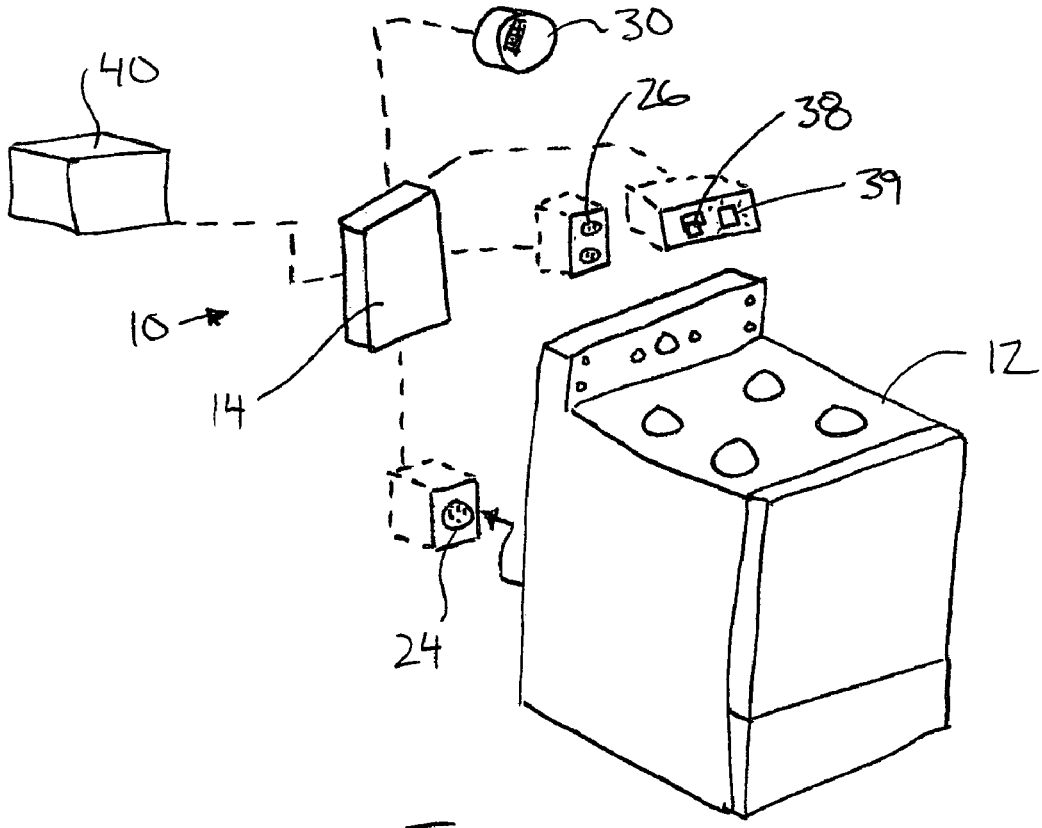

Turning now to FIG. 4 a further embodiment of the system is illustrated in which the components are hardwired into a building. In this instance the reset switch 38, the indicator 39, the receptacles 26, the socket 24, the detector 30 and the controller 14 each include their own respective housing with wiring being mainly hidden from view within the walls of the building.

Figure 2:
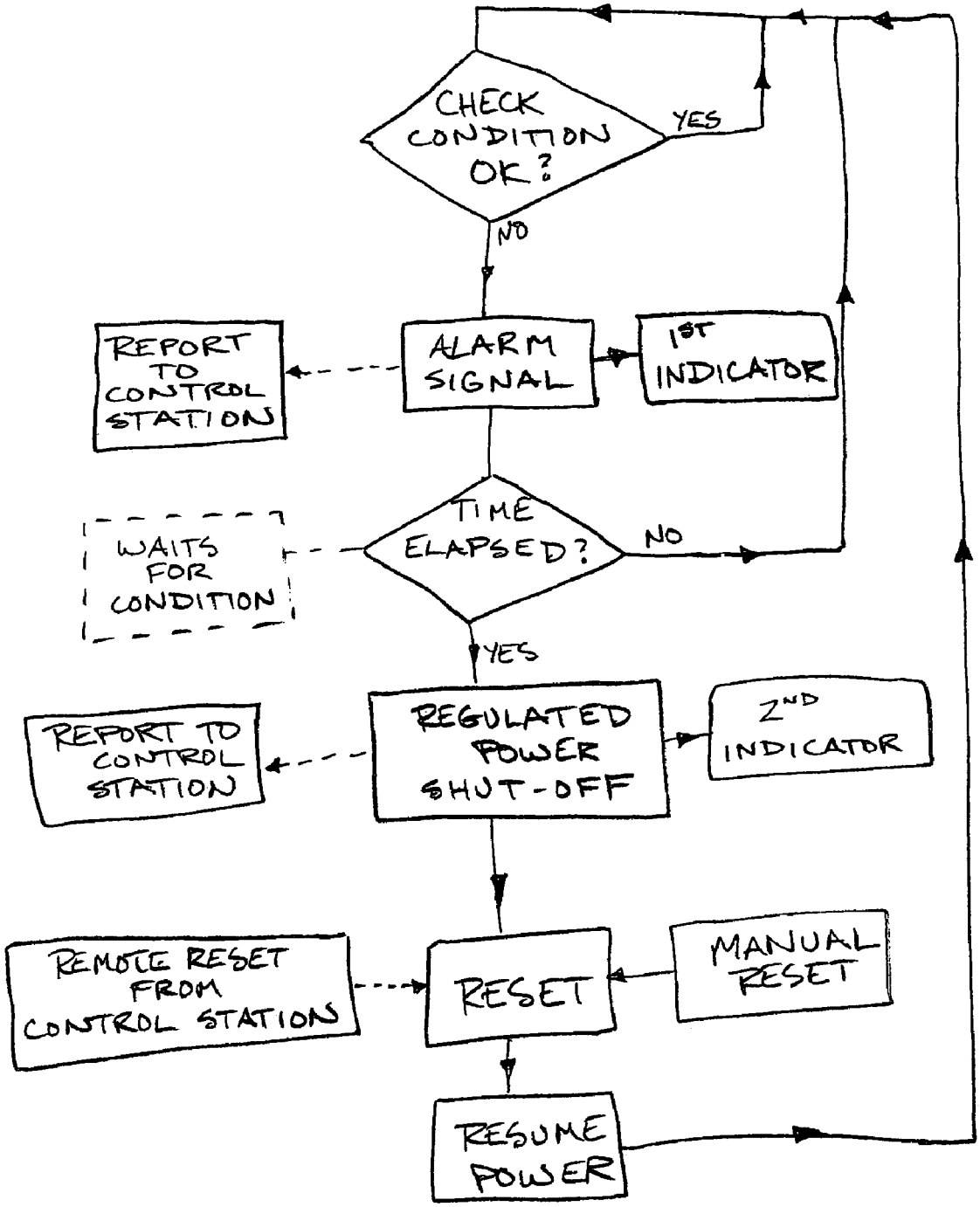
FIG. 2 is a flow chart illustrating the steps of operation of the system.

As illustrated in FIG. 2, operation begins with the detector first checking if a prescribed fire condition exists. This includes ensuring that the detector receives suitable power, that all connections are properly made and that any sensors of the detector have not detected any alarming conditions including heat, fire or smoke, and more particularly including sounds which may be indicative of a fire about to start, especially cooking fires for example grease fires. If a problem is detected and power is interrupted to the relay, an alarm signal is interpreted by the relay and this alarm signal is then reported to the main control station 40. If the alarm signal persists for the prescribed elapsed period of time, a prescribed fire condition is determined and a shutoff signal is sent to the controller to open the shutoff switch and accordingly interrupt power in the regulated power branch which interrupts the power supply to the appliance. Though any indicators of the detector itself are already actuated at this point, further indication that the appliance is being shut off then takes place and the shutoff signal is further reported to the main control station 40. The system remains in the shutoff condition until the circuit is reset by manual activation using the reset switch or by a remote reset signal from the main control station 40. Once this reset signal is received, the shutoff switch is closed to resume normal power to the regulated power branch and the relay and detector are reset to their starting positions. The detector then resumes checking for prescribed fire conditions. In the event that the elapsed period of time is not met by the relay, the shutoff signal is not generated but instead the detector is reset and then is permitted to continue checking for prescribed fire conditions.

The system according to the present invention relates to a cooking appliance and method of controlling its safe operation, while cooking.

A hazard control unit is added to an existing kitchen range or other appliance (electric, gas or other power source) with a fail safe detection circuit to allow intervention. The hazard control unit includes a switch for controlling all heating stove and oven elements, of the cooking appliance, wherein the entire appliance power supply can be switched off in the case of a predetermined unsafe condition, which is before stove fires can develop. The hazard control unit itself has a feature which indicates its on position. When the device is in off position the stove power supply is also off. The safety system is for electric stoves and ovens and uses a sensor to determine when the stove is heating beyond a certain rate which could constitute a safety hazard and for detecting the excessive presence of heat, smoke and/or flame, or other types of hazard indicators as in specific types of sounds. When a predetermined tolerance is exceeded, the power supply of the electric stove is shut down. Other sources of power supply such as natural gas, propane, heating fuel or others can also be controlled and shut down. Based upon the principle that when there is heat, smoke, and accumulations of various types of sounds, a fire will follow, the system intervenes upon certain accumulations of such harmful environmental factors. The user of the appliance is notified by means of audible sound, flashing warning lights, vibrating mechanisms or other means. When the user does not respond within a predetermined time, the system takes over and shuts down all cooking operations.

Typical fire detectors note abnormal environmental conditions such as the presence of smoke or an increase in temperature, light intensity or total radiation. Detectors for this purpose operate on principles involving thermal expansion, thermoelectric sensitivity, thermo conductivity, or photosensitivity. Of special interest in the present invention is that a specific sound is associated with cooking grease fires, therefore, a sound detector is incorporated into the system. The sound detection assists in eliminating false alarms as a result of non-threatening and minor occurrences (from a toaster for example) to the environment as mentioned.

While various embodiments of the present invention have been described in the foregoing, it is to be understood that other embodiments are possible within the scope of the invention. The invention is to be considered limited solely by the scope of the appended claims.

The invention claimed is:

1. A safety shut-off system, for controlling power supply to a plurality of appliances, the shut-off system comprising:

a shut-off switch arranged for connection in series with the power supply of each appliance;

a detector associated with each shut-off switch and arranged to detect a prescribed fire condition which is indicative of a potential fire before the potential fire ignites;

a controller associated with each shut-off switch and arranged for opening the switch in response to detection by the detector of the prescribed fire condition;

the controller including a failsafe mechanism arranged for opening the shut-off switch in response to a malfunction of the detector; and a main control station arranged for monitoring the controllers in association with the respective appliances.

2. The system according to claim 1 wherein loss of power to each detector is recorded as a malfunction arranged for opening the associated switch.

3. The system according to claim 1 wherein there is provided a relay to prevent opening of the each switch until the prescribed fire condition is detected over an elapsed period of time.

4. The system according to claim 3 wherein the detector activates a first indicator immediately in response to detecting a prescribed fire condition and the controller activates a second indicator in response to the shutoff switch being opened.

5. The system according to claim 1 wherein working components of the system are located remotely from one another within respective housings arranged for hardwiring within a building structure. there is provided a receptacle receiving power from the power supply interrupted by the shutoff switch.

6. The system according to claim 1 wherein the main control station includes a memory arranged for recording detections of prescribed fire conditions.

7. The system according to claim 1 wherein the main control station includes a resetting mechanism arranged for remotely closing the shut-off switch.

8. A safety shut-off system, for controlling power supply to an appliance, the shut-off system comprising:

a shut-off switch arranged for connection in series with the power supply of the appliance;

a detector arranged to detect a prescribed fire condition;

a first indicator arranged to immediately indicate the prescribed fire condition in response to the detector detecting the prescribed fire condition;

a controller arranged for opening the switch in response to detection by the detector of the prescribed fire condition;

a timer relay arranged to prevent opening of the switch until the prescribed fire condition is detected over an elapsed period of time; and a second indicator arranged to be activated in response to the shutoff switch being opened after the elapsed period of time has expired.

9. The system according to claim 8 wherein the prescribed fire condition comprises noises which are recorded by the detector which are indicative of the noises made by a cooking fire just before ignition thereof.

10. The system according to claim 8 wherein the controller includes a reset switch located remotely therefrom.

11. The system according to claim 8 wherein working components of the system are integrally located within a common housing.

12. The system according to claim 8 wherein the controller includes a reset switch arranged to be located remotely from the controller and arranged to close the shut-off switch.

13. A safety shut-off system, for controlling power supply to an appliance, the shut-off system comprising:

a shut-off switch arranged for connection in series with the power supply of the appliance;

a detector arranged to detect a prescribed fire condition; and a controller arranged for opening the switch in response to detection by the detector of the prescribed fire condition;

wherein the prescribed fire condition comprises noises which are recorded by the detector which are indicative of the noises made by a cooking fire just before ignition thereof.

14. A safety shut-off system arranged for controlling power supply to a plurality of appliances, the shut-off system comprising:

a shut-off switch arranged for connection in series with the power supply of each appliance;

a detector arranged to detect a prescribed fire condition;

a controller associated with each switch arranged for opening the switch in response to detection by the detector of the prescribed fire condition; and a main control station arranged for monitoring the controllers in association with the plurality of appliances respectively;

the main control station including a memory arranged for recording detections of prescribed fire conditions.

15. The system according to claim 14 wherein the prescribed fire condition includes elevated temperatures, ionization of air, smoke which blocks the light transmission through air, sounds indicative of a tire about to start or any combination thereof.

16. A safety shut-off system arranged for controlling power supply to a plurality of appliances, the shut-off system comprising:

a shut-off switch arranged for connection in series with the power supply of each appliance;

a detector arranged to detect a prescribed fire condition;

a controller associated with each switch arranged for opening the switch in response to detection by the detector of the prescribed fire condition; and a main control station arranged for monitoring the controllers in association with the plurality of appliances respectively;

the main control station including a resetting mechanism arranged for remotely closing the shut-off switches.

17. The system according to claim 16 wherein the main control station includes a memory arranged for recording detections of prescribed fire conditions.

18. The system according to claim 16 wherein the prescribed fire condition includes elevated temperatures, ionization of air, smoke which blocks the light transmission through air, sounds indicative of a fire about to start or any combination thereof.

* * * * *